United States Patent [19]

Krieger

[11] Patent Number: 4,837,947

[45] Date of Patent: Jun. 13, 1989

[54] DEVICE FOR ACTING UPON WEBS OF MATERIAL WITH A FLOWING MEDIUM

[76] Inventor: Kurt Krieger, Oberlinstrasse 16, Düsseldorf, Fed. Rep. of Germany, D-4000

[21] Appl. No.: 183,733

[22] PCT Filed: Jul. 30, 1987

[86] PCT No.: PCT/DE87/00336

§ 371 Date: Mar. 31, 1988

§ 102(e) Date: Mar. 31, 1988

[87] PCT Pub. No.: WO88/01038

PCT Pub. Date: Feb. 11, 1988

[30] Foreign Application Priority Data

Jul. 31, 1986 [DE] Fed. Rep. of Germany ..... 3626016

[51] Int. Cl.[4] ..... F26B 13/00

[52] U.S. Cl. ..... 34/156; 34/10; 226/97

[58] Field of Search ..... 34/10, 156, 117, 120; 226/97, 7

[56] References Cited

U.S. PATENT DOCUMENTS 4,472,888 9/1984 Spiller ..... 34/156

FOREIGN PATENT DOCUMENTS 0192429 8/1986 European Pat. Off. .

2802610 5/1983 Fed. Rep. of Germany .

2836103 3/1985 Fed. Rep. of Germany .

2028479 12/1982 United Kingdom .

*Primary Examiner*—Henry A. Bennet

*Attorney, Agent, or Firm*—Holman & Stern

[57] ABSTRACT

The device utilizes air or other flowing medium to act upon and guide in a hovering manner webs of material, particularly for drying the web. The device has an air duct or the like which comprises at least one nozzle region extending over the width of the web and having a curved wall surface running substantially parallel to the plane of movement of the web. The wall sections defining the air duct are provided with individual outlets opposite a respective guide surface for the air flow in the nozzle region on either side of a transverse plane arranged in the longitudinal direction of the air duct and perpendicularly to the plane of movement of the web. Preferably, there are two wall sections provided opposite one another, each having outlets and forming a guide surface for air flows issuing from the outlets in the other wall section. Preferably, the outlets in one wall section are offset from the outlets in the other wall section in the lateral and/or vertical direction.

The device provides stable operating conditions even under varying temperature influences. It is also simple in design and therefore easy to produce.

37 Claims, 4 Drawing Sheets

DEVICE FOR ACTING UPON WEBS OF MATERIAL WITH A FLOWING MEDIUM

CROSS REFERENCE TO RELATED APPLICATION(S)

This U.S. application stems from PCT International Application No. PCT/DE87/00336, filed July 30, 1987.

TECHNICAL FIELD

The invention relates to a device for acting upon and guiding in hovering manner webs of material, in particular webs of paper, with air or another flowing medium, mainly for drying the web. An air duct or the like is provided which comprises at least one nozzle region, extending over the width of the web, with a curved wall surface formed by a boundary of the air duct and a flat wall surface which is adjacent thereto and runs substantially parallel to the plane of movement of the web.

STATE OF THE ART

In the known devices, in which air is blown against a moving web in order to dry the web, the respective air outlet opening is constructed as a nozzle slit extending over the width of the web (DE-C2 28 36 103). Such slits pass from so-called nozzle tanks and are limited on one side by a substantially flat wall and on the other side by a wall having a curved portion and an adjacent straight portion running parallel to the plane of the web.

Known nozzle tanks with nozzle slits are normally produced from sheet metal. Owing to the relatively small wall thickness, the metal sheets tend to warp and to become distorted under the various operating conditions, in particular under changing temperatures and pressure conditions. This also leads to undesirable changes in the region of the nozzle slit so that the quantity of air and possibly the flow parameters also vary and this can be very disadvantageous, depending on the extent of such influences.

STATEMENT OF THE INVENTION

An object of the invention is to take account of existing problems and shortcomings and to provide a device of the type mentioned at the outset which, with a simple design, affords operating conditions which are as stable as possible even under varying temperature influences. In particular, the device should also be very convenient to produce. Furthermore, the invention aims to provide an advantageous configuration of the device in detail. Further associated problems with which the invention deals follow from the respective description of the solution set out.

In a typical device, the invention proposes that individual outlets for air be provided in wall sections which define the air duct opposite respective guide surfaces for the air flow in the nozzle region on either side of a transverse plane running in the longitudinal direction of the air duct and perpendicularly to the plane of movement of the web.

The outlets can be designed as mouth pieces, individual nozzles or the like. In a very advantageous design, holes in the wall sections of the air duct are provided as outlets for the air.

The device according to the invention can be produced very simply and allows perfect operation even under varying operating conditions. Even if wall sections are displaced slightly under undesirable conditions, the quantity of air still remains constant. The flow conditions remain in the manner desired at any given time. Nevertheless, the device can easily be adapted to different requirements. Depending on the circumstances and requirements of the respective application, a nozzle region of the above-mentioned design can be provided at one or more points of one and the same air duct, as viewed in the longitudinal direction of the web.

A desirable design is characterised in that wall sections provided with two outlets are arranged immediately opposite one another and each of these wall sections forms, at least in part, a guide surface for air flows issuing from the outlets of the other wall section. Particularly desirable conditions for numerous cases can be achieved with such a design. It serves, in particular, to produce air flows according to the so-called Coanda effect.

It may be advantageous, in principle, to offset the outlets in one wall element relative to the outlets in the other wall element, in particular in the lateral direction and/or in the height direction.

Air outlets can be provided in curved wall surfaces or also in flat wall portions, particularly those which are at an acute angle to the transverse plane and pass into curved wall surfaces.

The flat wall portions can be inclined at the same angle, but also at different angles to the transverse plane. Differing requirements can thus simply be allowed for without a need for particular expense.

The flat wall portions which are at an angle to one another can be formed by a continuous wall or also by wall sections which are brought together and are joined together at the contact point, for example, by screws, spot welding or in a different manner.

A particularly advantageous design of the device is characterised in that, between the outlets located on either side of the transverse plane in wall sections of the air duct, there are provided guide surfaces which face said outlets and guide the respective air flows issuing from them toward the plane of movement of the web.

This is a versatile design which can easily be adapted to different requirements.

A basic feature of particular importance is that at least one sealing member extending in the longitudinal direction of the air duct is provided in the base of the nozzle region of an air duct. Not only is said air duct particularly desirable in terms of production, but it also allows the flow conditions to be influenced in numerous ways. For this purpose, guide surfaces are formed, in particular, on the side of the sealing member facing the plane of movement of the web.

In a favourable design, guide surfaces are provided on sides remote from one another of a projecting part of the sealing member. Air flows can thus be deflected towards the web in the sense of rebounding flows. The guide surfaces can be designed and arranged symmetrically or asymmetrically about the transverse plane. An inclination to the transverse plane can also be provided for the guide surfaces.

In another advantageous design, the sealing member has guide surfaces which are roof-shaped in design. This is advantageous for cases, among others, in which wall sections are arranged opposite one another in the nozzle region and air flows are directed from each side to the other.

The position of the outlets relative to the sealing member can be selected according to the respective circumstances. In many cases it is desirable to arrange outlets in the immediate vicinity of a boundary surface of the sealing member.

The respective sealing member is advantageously arranged in the nozzle region in such a way, in particular between two wall sections of the air duct, that it can easily be exchanged. The operating conditions can thus also be modified easily, for example if a web of a material other than that treated hitherto is to be guided through the device. Such exchangeable sealing members can then have guide surfaces of a different design.

The seling members can be composed of several parts. They are advantageously designed as units which are ready for installation.

Desirable further embodiments of the device are mentioned in the claims.

Further details, features and advantages of the invention can be seen from the following description of embodiments, from the associated drawings and from the claims.

SHORT DESCRIPTION OF THE DRAWINGS

PREFERRED METHODS OF CARRYING OUT THE INVENTION

Figure 1:
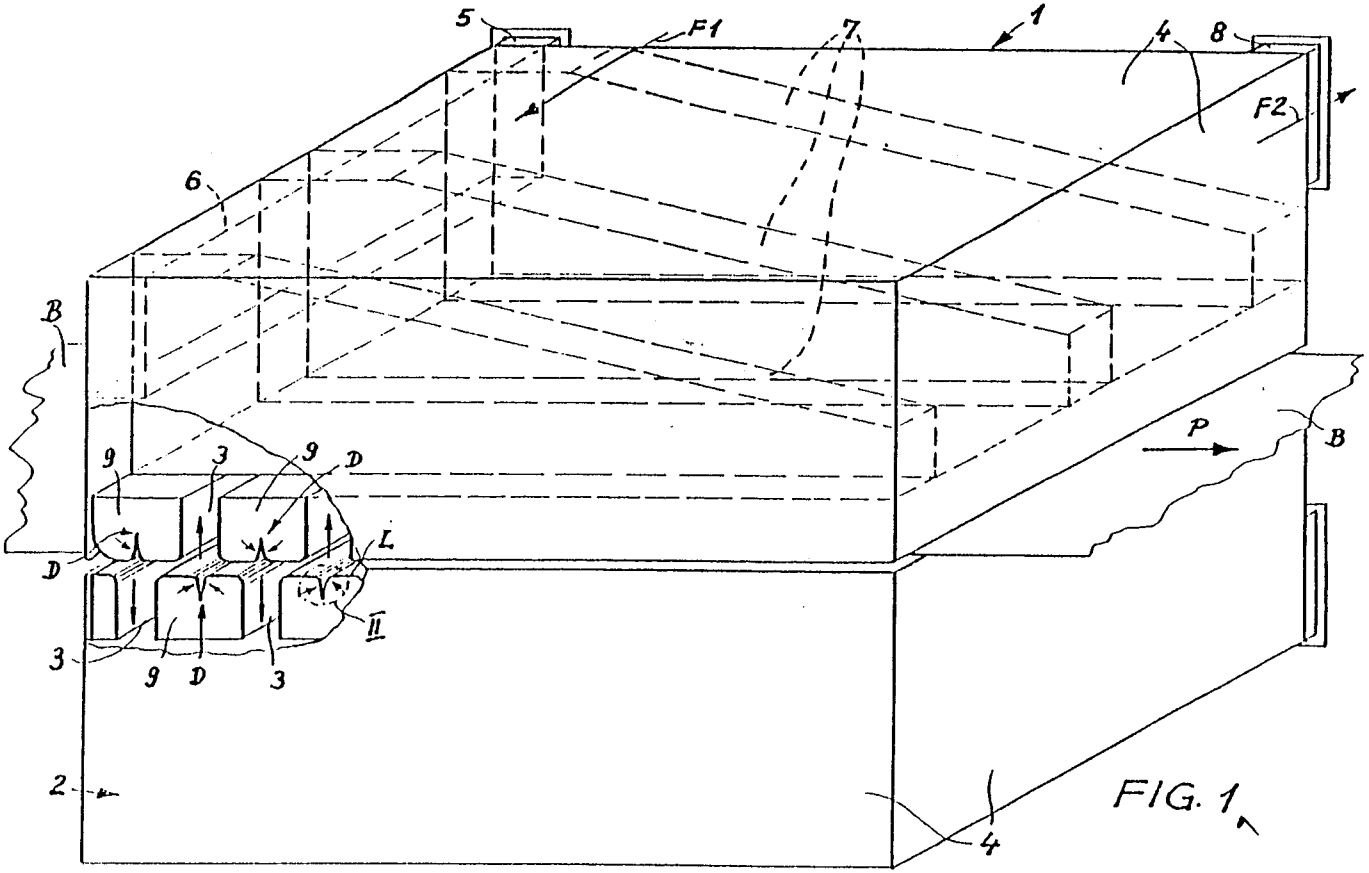
FIG. 1 shows a unit equipped with devices according to the invention for the treatment of a passing web of material.

The apparatus shown in FIG. 1 serves, for example, for the drying of a paper web B which performs a rectilinear movement in the direction of the arrow P and, as it does so, is guided between an upper unit 1 and a lower unit 2. The mechanisms for driving the web are not shown and can be of known design. Respective air supply ducts 9 are arranged in the lower part of unit 1 and in the upper part of unit 2 with spacing in the longitudinal direction of the web so that spaces 3 remain between the individual ducts 9 and communicate with the interior of the unit 1 which is sealed elsewhere by walls 4. The same applies to the ducts 9 of the lower unit 2. The ducts 9 of the upper unit 1 are offset from the ducts 9 of the lower unit 2 by half a space in each case in such a way that a nozzle region D of an upper duct 9 faces a space between two lower ducts 9 and vice versa. Depending on the requirements and circumstances in the respective individual case, the device can be arranged in a different manner, for example such that the ducts 9 with the nozzle regions D and consequently also the spaces 3 each face one another.

Air of the desired temperature and desired pressure passes through an inlet 5 in the direction of the arrow F1 into a distributing housing 6 located inside the unit 1 and from it into a branched housing 7 of which each branch communicates through openings (not shown) with the supply ducts 9. The same applies to the lower unit 2. The air which has issued from the nozzle regions D brushes over the web B then passes through the spaces 3 into the above-mentioned interior of the unit 1 from which it issues through an outlet 8. Corresponding devices for supplying and discharging the air to the unit 1 and away from it can be of known design. The arrow F2 denotes the outlet flow.

Similarly, the same measures are provided for guiding the air in the lower unit 2 as in the unit 1.

Figure 2:
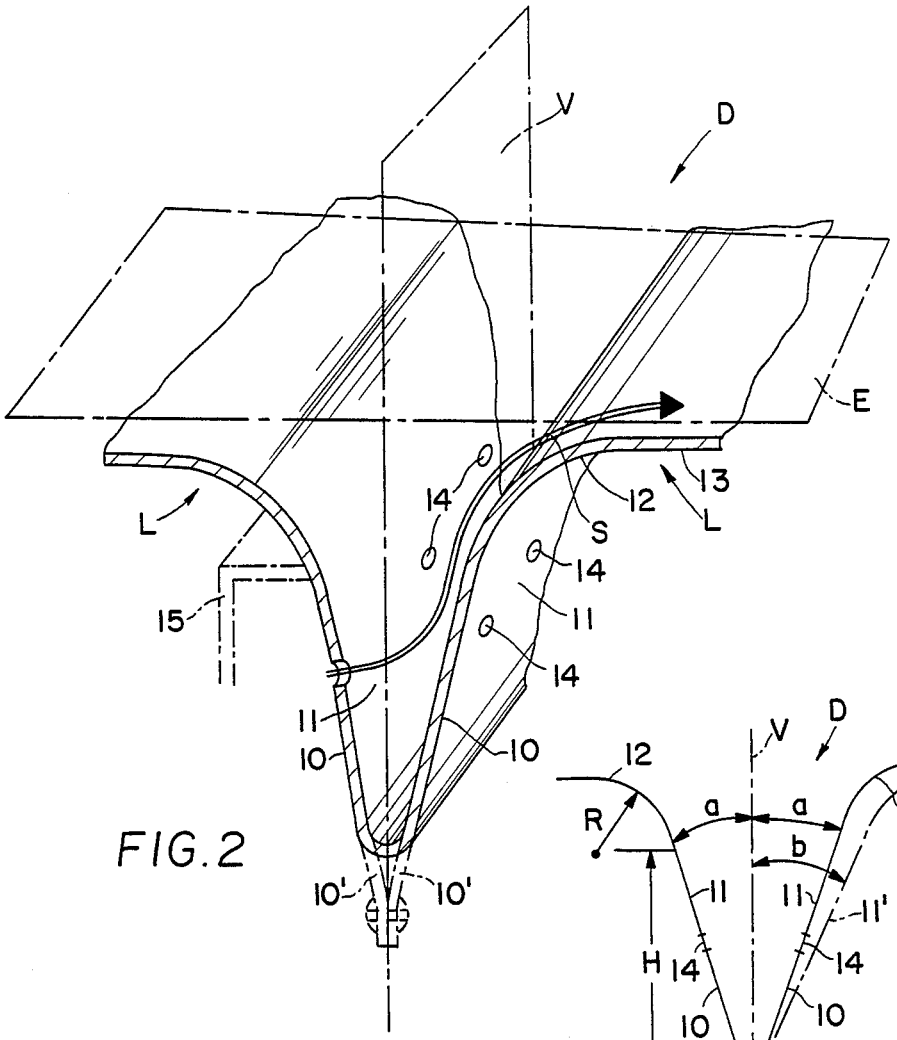
FIG. 2 shows the position II in FIG. 1 on an enlarged scale in a perspective view.
Figure 3:
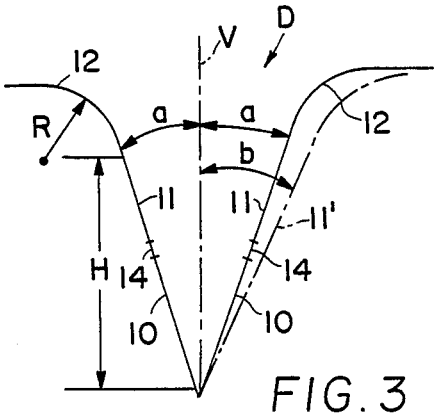
FIG. 3 shows a nozzle region in a schematic view.
Figure 4:
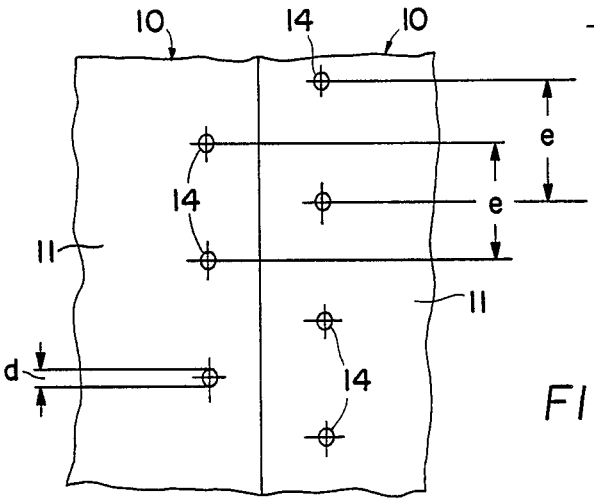
FIG. 4 shows a plan view of a portion of a nozzle region.

An advantageous embodiment of the nozzle region D is illustrated in FIGS. 2 to 4 with a few modifications.

A wall 10 intended to define an air supply duct 9 is shaped such that wall regions which are at acute angles to one another each pass into a curved portion 12 to which flat portions 13 are connected. These portions 12 and 13 can be considered as guide surface L for an air flow.

The wall regions 10 are provided with air outlets in the form of punched holes 14, the outlets on one side being mutually displaced in each case on one side from those on the other side in the longitudinal direction of the nozzle region D, i.e. transversely to the web direction, as shown in particular in FIG. 4. The facing regions of the walls 10 form rebound surfaces 11. The air flows issuing from the holes 14 on one side strike the opposing rebound surface 11 and vice versa. As it continues, the flow is then guided along the curved region 12 and the adjacent region 13. This is indicated schematically by the line S for one side in FIG. 2.

In the embodiment illustrated, the rebound surfaces 11 are inclined by the same respective angle a to a transverse plane V perpendicular to the plane of movement E of the material web B, as shown in FIG. 3. However, it is also possible, depending on the requirements, to select the inclination of the two rebound surfaces differently. FIG. 3 shows this on a rebound surface 11' which is indicated in dot-dash lines and, with the angle b, has a greater inclination than the other rebound surface 11.

The inclination is preferably in the region of about 10° to 40°. Angles of about 15° are particularly desirable.

In the embodiment shown in FIG. 2, all portions are formed by a continuous wall 10 which is suitably curved in the lower vertex region. As shown in dot-dash lines, the rebound surfaces 11 can also be formed by separate wall portions 10' which are brought together at the ends and are joined together tightly by spot welding or in another suitable manner.

A nozzle region of the described type is preferably located approximately in the centre of an air supply duct 9, as shown in FIG. 1. In further embodiments, two such nozzle regions are spaced apart on a supply duct 9.

In a further possibility, only one rebound surface 11 is provided on the nozzle region and is provided with corresponding opposing outlets. In this case, the design is such that the wall portion 10 forming the right-hand rebound surface 11 in FIG. 2 has no outlets 14 whereas such outlets are provided only in the left-hand wall portion 10 in FIG. 2. It may not then be necessary to provide a guide surface L on this side, but, for example, an angled wall extension 15 can be joined to the wall portion 10 as an otherwise normal boundary for a feed duct, as indicated in dot dash lines in FIG. 2.

Regardless of the details of the design, advantageous values for the outlet diameter d of the outlets are from about 3 to 7 mm. The intervals e between outlets (FIG.

4) can lie, in particular, in the region of from about 10 to 30 mm.

It is also within the scope of the invention to provide more than one row of outlets 14 in each case and/or to offset the outlets 14 also in the vertical direction.

The height of a wall section (FIG. 3) forming a respective rebound surface 11 preferably lies in the region of H=15 mm to H=30 mm, without this being considered as a restriction.

The radius R of the curved portion 12 adjacent to a rebound surface 11 is advantageously selected in the range from about 5 to 25 mm. However, other values are also feasible, depending on the circumstances.

Figure 5:
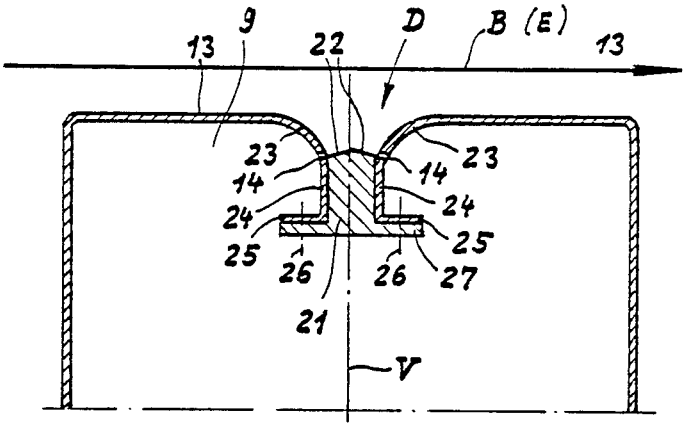
FIG. 5 shows another design of a nozzle region in a cross section through an air duct.

FIG. 5 shows an embodiment in which a sealing member 21 is located on the base of the nozzle region D. The sealing member extends over the entire width of the air duct 9 and has, on its side facing the plane of movement of the web B, guide surfaces 22 which run in the form of a roof in this embodiment. Air outlets in the form of orifices 14 are provided in curved wall sections 23 in the immediate vicinity of these guide surfaces 22 forming the boundary of the sealing member 21. The air flows issuing from these orifices each pass along the associated guide surface 22 and then strike the curved wall surface 23 where the Coanda effect occurs as in the embodiment according to FIG. 2 so that the air flows round this wall surface and along the adjacent flat wall surface 13 and is thus applied to and guides, in hovering manner, the web B.

Figure 8:
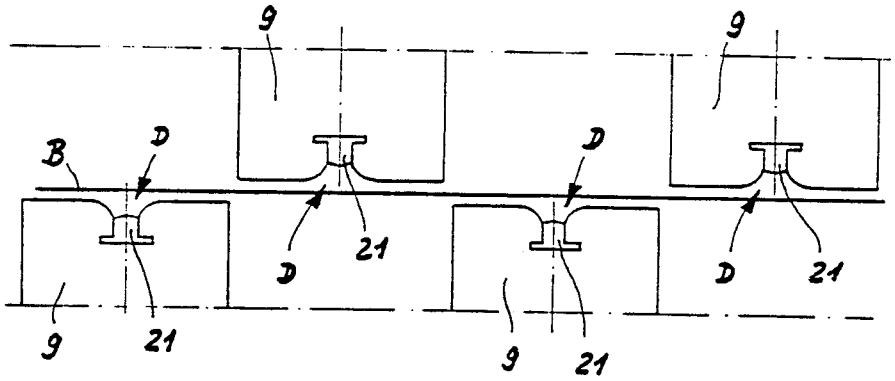
FIG. 8 shows an arrangement of air ducts with nozzle regions for the charging of a web of material.

FIG. 8 shows part of a drying apparatus for a web B in which air ducts 9 with nozzle regions D of the type described are provided.

The sealing member 21 is advantageously designed as an exchangeable unit which is ready for installation.

Figure 7:
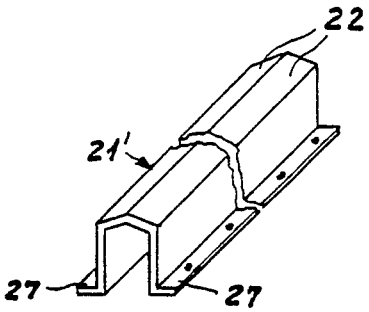
FIG. 7 shows a sealing member in a perspective view.

FIG. 7 illustrates such a sealing member 21' in the form of a metal profile which is, for example, drawn.

A sealing member of this type or of a similar design can easily be inserted between two wall sections 24 of the air duct 9, these wall sections resting close against the sealing member. The sealing member can be fixed, for example, by screws 26 which are merely indicated by their centre lines in FIG. 5 and which penetrate holes in flange sections 25 of the air duct 9 and in flange sections 27 of the sealing member 21.

Figure 6:
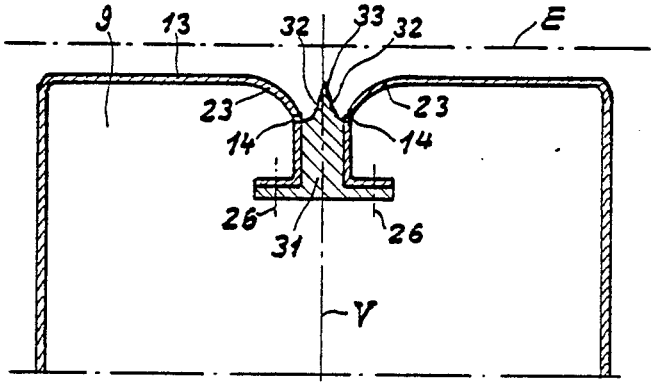
FIG. 6 shows a further embodiment of a nozzle region in a section corresponding to FIG. 5.

FIG. 6 shows a sealing member 31 which is arranged similarly to the sealing member 21 in the design according to FIG. 5 on the base of the nozzle region D and which comprises guide surfaces 32 on the mutually remote sides of a part 33 projecting toward the plane of movement E of the web in the region of the transverse plane V.

Outlets 14 for the air are also provided in this case in the immediate vicinity of the beginning of the guide surfaces 32 in wall sections 23. The air flows issuing from them are guided by the guide surfaces 32 such that they each run substantially perpendicularly in the direction of a rebounding flow relative to the plane of movement E.

As a modification of the illustration in FIG. 6, the projecting part 33 of the sealing member 31 can also lie outside the transverse plane V and, in particular, it can also be arranged at an angle to the transverse plane. The two guide surfaces 32 can also have differing respective positions or inclinations. The same applies to the guide surfaces 22 in the design according to FIG. 5.

Figure 9:
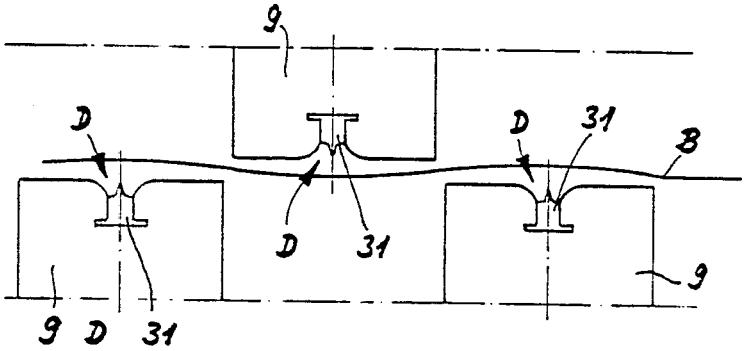
FIG. 9 shows a further arrangement of air ducts with nozzle regions.

FIG. 9 illustrates part of a drying apparatus in which air chambers 9 with sealing members 31 are provided in the nozzle region D. Such a design is suitable, among other things, for material webs B which are thicker or have a higher specific gravity. Owing to the rebounding flow effect, these webs can undulate slightly in the longitudinal direction. This is advantageous, among other things, if it is important to prevent the edge of the web from curling. With webs which are thinner or have a lower specific gravity, it is usually possible to move them in a substantially straight manner, as illustrated in FIG. 8.

Furthermore, it also falls within the scope of the invention to provide nozzle regions of differing design within an apparatus or treatment section, for example nozzle designs according to FIG. 5 on one portion of the treatment section and nozzle designs according to FIG. 6 on the other portion.

All features mentioned in the foregoing description and illustrated in the drawings should be considered alone or also in combinations as falling within the invention, providing that this is permitted by the known state of the art.

I claim:

1. A device for acting upon and guiding in hovering manner webs of a flowing medium, comprising:

an air duct, at least one nozzle region extending over the width of the air duct with a curved wall surface formed by a boundary of the air duct and an adjacent flat wall surface running substantially parallel to the plane of the movement of the web, and individual outlets for air provided in wall sections defining the air duct opposite a respective guide surface for guiding the air flow issuing from the outlets in the nozzle region on either side of a transverse plane arranged in the longitudinal direction of the air duct and perpendicularly to the plane of movement of the web.

2. A device according to claim 1, characterised in that holes (14) in the wall sections (10, 23) of the air duct (9) are provided as outlets.

3. A device according to claim 1, characterised in that two wall sections (10, 23) provided with outlets (14) are arranged immediately opposite one another and each of these wall sections (10, 23) forms, at least in part, a guide surface for air flows issuing from the outlets (14) in the other wall section (10, 23).

4. A device according to claim 1, characterised in that outlets (14) in one wall section (10, 23) are offset from the outlets (14) in the other wall section (10, 23) in the lateral and/or vertical direction.

5. A device according to claim 1, characterised in that outlets (14) are provided in curved wall sections (23).

6. A device according to claim 1, characterised by two flat wall portions (10) which are each at an acute angle (a) to the transverse plane (V) and pass into curved wall surfaces (12).

7. A device according to claim 6, characterised in that outlets (14) are provided in the flat wall portions (10).

8. A device according to claim 6, characterised in that the flat wall portions (10) are arranged at equal angles (a) to the transverse plane (V).

9. A device according to claim 6, characterised in that the flat wall portions (10) are arranged at different angles (a, b) to the transverse plane (V).

10. A device according to claim 6, characterised in that the flat wall portions (10) are formed by a continuous wall.

11. A device according to claim 6, characterised in that the flat wall portions are formed by wall sections (10') which are joined together.

12. A device according to claim 6, characterised in that the inclination of the flat wall portions (10) is in the region of about 10° to 40° with respect to the transverse plane (V).

13. A device according to claim 12, characterised in that the inclination of the flat wall portions (10) is in the region of about 14° to 16°.

14. A device according to claim 1, characterised in that, between the outlets (14) located on either side of the transverse plane (V) in wall sections (23) there are provided guide surfaces (32) which face them and guide the respective air flows issuing from them towards the plane of movement (E) of the web (B) and against the web (B).

15. A device according to claim 1, characterised in that at least one sealing member (21, 31) extending in the longitudinal direction of the air duct (9) is provided in the base of the nozzle region (D).

16. A device according to claim 15, characterised in that guide surfaces (22, 32) are formed on the side of the sealing member (21, 31) facing the plane of movement (E) of the web (B).

17. A device according to claim 15, characterised in that guide surfaces (32) are provided on mutually remote sides of a projecting part (33) of the sealing member (31).

18. A device according to claim 15, characterised in that the sealing member (31) has guide surfaces (22) which are roof-shaped in construction.

19. A device according to claim 15, characterised in that outlets (14) are arranged in the immediate vicinity of a boundary surface (22, 32) of the sealing member (21, 31).

20. A device according to claim 15, characterised in that sealing members (21, 31) are provided in an exchangeable arrangement.

21. A device according to claim 15, characterised in that the sealing members (21, 31) are each designed as units which are ready for installation.

22. A device according to claim 1, characterised in that the outlets (14) have an outlet diameter (d) in the range of about 3 to 7 mm.

23. A device according to claim 1, characterised in that the outlets (14) have spacing (e) in the range of about 10 to 30 mm in the longitudinal direction of the nozzle region (D).

24. A device according to claim 1, characterised in that the curved wall surface (12, 23) has a radius (R) in the range of about 5 to 25 mm.

25. A device according to claim 1, characterised in that the nozzle region (D) is provided approximately in the centre of an air duct (9).

26. A device according to claim 1, characterised in that air ducts (9) having nozzle regions (D) of different designs are provided in the course of a treatment section.

27. The device of claim 1, wherein said guide surfaces are each formed by different ones of said curved wall and adjacent flat wall surfaces while air flowing from said individual outlets on each side of the transverse plane strikes and rebounds from a rebound surface of an opposing one of said wall sections.

28. The device of claim 1, further comprised of a plurality of said air ducts arranged in two rows on opposite sides of said plane with said transverse planes in each of said rows being spaced apart along the length of said plane of movement.

29. A device for acting upon and guiding in a hovering manner webs of a flowing medium, comprising:

a pair of wall sections arranged immediately opposite from one another forming an air duct with each wall section including a flat wall portion passing into a curved wall surface and defining an acute angle with a transverse plane arranged in a longitudinal direction of the air duct and perpendicularly to a plane of movement of a web past the air duct;

at least one nozzle region extending over the width of the air duct with said curved wall surface formed by a boundary of the air duct and an adjacent flat wall surface running substantially parallel to the plane of movement of the web; and individual outlets for air provided in said wall sections forming the air duct opposite a respective one of opposed guide surfaces formed by corresponding ones of said wall sections for guiding the air flow issuing from the outlets in the nozzle region.

30. The device of claim 29, wherein said outlets are provided in the flat wall portions.

31. The device of claim 30, wherein the flat wall portions are arranged at equal angles to the transverse plane.

32. The device of claim 30, wherein the flat wall portions are arranged at different angles to the transverse plane.

33. The device of claim 29, wherein the outlets are provided in the curved wall sections.

34. The device of claim 33, wherein the flat wall portions are arranged at equal angles to the transverse plane.

35. The device of claim 33, wherein the flat wall portions are arranged at different angles to the transverse plane.

36. The device of claim 29, wherein said guide surfaces are each formed by different ones of said curved wall and adjacent flat wall surfaces while air flowing from said individual outlets on each side of the transverse plane strikes and rebounds from a rebound surface of an opposing one of said wall sections.

37. The device of claim 29, further comprised of a plurality of said air ducts arranged in two rows on opposite sides of said plane with said transverse planes in each of said rows being spaced apart along the length of said plane of movement.

* * * * *